US010329714B2

(12) United States Patent
Chaplin

(10) Patent No.: US 10,329,714 B2
(45) Date of Patent: Jun. 25, 2019

(54) GUIDING RESISTANT FORMING FABRIC WITH BALANCED TWILL MACHINE SIDE LAYER

(71) Applicant: AstenJohnson, Inc., Charleston, SC (US)

(72) Inventor: Derek Chaplin, Ottawa (CA)

(73) Assignee: AstenJohnson, Inc., Charleston, SC (US)

( * ) Notice: Subject to any disclaimer, the term of this patent is extended or adjusted under 35 U.S.C. 154(b) by 19 days.

(21) Appl. No.: 15/794,410

(22) Filed: Oct. 26, 2017

(65) Prior Publication Data

US 2018/0119352 A1 May 3, 2018

Related U.S. Application Data

(60) Provisional application No. 62/414,304, filed on Oct. 28, 2016.

(51) Int. Cl.

| | |
|---|---|
| ***D03D 11/00*** | (2006.01) |
| ***D21F 7/08*** | (2006.01) |
| ***D03D 13/00*** | (2006.01) |
| ***D21F 1/00*** | (2006.01) |

(52) U.S. Cl.

CPC ..... *D21F 7/083* (2013.01); *D03D 11/00* (2013.01); *D03D 13/004* (2013.01); *D21F 1/0045* (2013.01); *D10B 2331/04* (2013.01); *D10B 2331/061* (2013.01); *D10B 2331/301* (2013.01); *D10B 2403/023* (2013.01)

(58) Field of Classification Search

USPC ..... 162/358

See application file for complete search history.

(56) References Cited

U.S. PATENT DOCUMENTS

| | | | |
|---|---|---|---|
| 3,464,461 | A | 9/1969 | Cumming |
| 3,652,389 | A | 3/1972 | Helland |
| 4,592,395 | A | 6/1986 | Borel |
| 4,942,077 | A | 7/1990 | Wendt et al. |
| 4,945,952 | A | 8/1990 | Vohringer |
| 4,967,805 | A | 11/1990 | Chiu et al. |
| 5,826,627 | A | 10/1998 | Seabrook et al. |
| 5,881,764 | A | 3/1999 | Ward |
| 6,123,116 | A | 9/2000 | Ward et al. |
| 6,145,550 | A | 11/2000 | Ward |
| 6,179,013 | B1 | 1/2001 | Gulya |
| 6,837,277 | B2 | 1/2005 | Troughton et al. |
| 7,114,529 | B2 | 10/2006 | Johnson et al. |
| 7,441,566 | B2 | 10/2008 | Ward |
| 7,717,141 | B1 | 5/2010 | Quigley |
| 2003/0024590 | A1 | 2/2003 | Stone |
| 2004/0182465 | A1 | 9/2004 | Ward |
| 2007/0151617 | A1 | 7/2007 | Fahrer et al. |
| 2009/0050231 | A1 | 2/2009 | Barrett |

FOREIGN PATENT DOCUMENTS

| | | |
|---|---|---|
| DE | 3044762 | 5/1982 |
| EP | 0053317 | 6/1982 |
| WO | 2016158640 | 6/2016 |

OTHER PUBLICATIONS

Miah, Rubel, Md., An Overview of Twill Weave, Department of Textile Engineering, World University of Bangladesh, 10 pgs., http://textilelearner.blogspot.com/2013/07/different-types-of-twill-weave.html#ixzz4Nz2Ad600.

*Primary Examiner* — Mark Halpern

(74) *Attorney, Agent, or Firm* — Volpe and Koenig, P.C.

(57) ABSTRACT

A forming fabric for a papermaking machine woven according to a repeating fabric weave pattern is provided. The fabric includes a PS layer having a PS surface, with the PS layer including PS warps and PS wefts interwoven in a first repeating pattern, and a MS layer having a MS surface, with the MS layer including interwoven MS warps and MS wefts. A plurality of pairs of binder weft yarns is provided, with each of the pairs of binder weft yarns comprising first and second binder weft yarns that are interwoven according to a binder weft pattern with the PS warps and the MS warps to bind the PS and MS layers together in the composite forming fabric, and each interchanges between the layers at exchange points. In each pattern repeat of the fabric weave pattern, each of the MS warps forms one or more MS warp knuckles over single ones of the MS wefts, the MS warp knuckles of the MS warps are arranged in a broken twill having an offset mirror symmetric arrangement, and a direction of the broken twill reverses after an equal number of MS warp knuckles.

18 Claims, 14 Drawing Sheets

3x3 TWILL

| | 1 | 2 | 3 |
|---|---|---|---|
| 1 | 1 | 2 | 3 |
| 2 | 1 | 2 | 3 |
| 3 | 1 | 2 | 3 |

FIG. 6
(PRIOR ART)

3x6 BALANCED TWILL

| | 1 | 2 | 3 | |
|---|---|---|---|---|
| W1 | 1 | 2 | 3 | |
| W2 | 1 | 2 | 3 | 126A |
| W3 | 1 | 2 | 3 | |
| W4 | 1 | 2 | 3 | |
| W5 | 1 | 2 | 3 | 126A |
| W6 | 1 | 2 | 3 | |

120A

FIG. 7

OPPOSING TWILLS AT MIRROR ANGLES

| | 1 | 2 | 3 | 1 | 2 | 3 |
|---|---|---|---|---|---|---|
| W1 | 1 | 2 | 3 | 1 | 2 | 3 |
| W2 | 1 | 2 | 3 | 1 | 2 | 3 |
| W3 | 1 | 2 | 3 | 1 | 2 | 3 |
| W4 | 1 | 2 | 3 | 1 | 2 | 3 |
| W5 | 1 | 2 | 3 | 1 | 2 | 3 |
| W6 | 1 | 2 | 3 | 1 | 2 | 3 |
| | 1 | 2 | 3 | 1 | 2 | 3 |
| | 1 | 2 | 3 | 1 | 2 | 3 |
| | 1 | 2 | 3 | 1 | 2 | 3 |
| | 1 | 2 | 3 | 1 | 2 | 3 |
| | 1 | 2 | 3 | 1 | 2 | 3 |
| | 1 | 2 | 3 | 1 | 2 | 3 |

100A

126A

120A

126A

FIG. 8

4x4 TWILL

| | 1 | 2 | 3 | 4 |
|---|---|---|---|---|
| 1 | 1 | 2 | 3 | 4 |
| 2 | 1 | 2 | 3 | 4 |
| 3 | 1 | 2 | 3 | 4 |
| 4 | 1 | 2 | 3 | 4 |

FIG. 9
(PRIOR ART)

6x24 BALANCED WEAVE

| | 1 | 2 | 3 | 4 | 5 | 6 |
|---|---|---|---|---|---|---|
| W1 | 13 | 14 | 15 | 16 | | 18 |
| W2 | 13 | | 15 | 16 | 17 | 18 |
| W3 | 13 | 14 | 15 | 16 | 17 | |
| W4 | 13 | 14 | | 16 | 17 | 18 |
| W5 | | 14 | 15 | 16 | 17 | 18 |
| W6 | 13 | 14 | 15 | | 17 | 18 |
| W7 | 13 | | 15 | 16 | 17 | 18 |
| W8 | 13 | 14 | 15 | 16 | | 18 |
| W9 | 13 | 14 | | 16 | 17 | 18 |
| W10 | 13 | 14 | 15 | 16 | 17 | |
| W11 | 13 | 14 | 15 | | 17 | 18 |
| W12 | | 14 | 15 | 16 | 17 | 18 |
| W13 | 24 | 23 | 22 | 21 | | 19 |
| W14 | 13 | | 23 | 22 | 21 | 20 |
| W15 | 13 | 24 | 23 | 22 | | 20 |
| W16 | | 24 | 23 | 22 | 21 | 20 |
| W17 | 13 | 24 | 23 | | 21 | 20 |
| W18 | 13 | 24 | 23 | 22 | 21 | |
| W19 | 13 | 24 | | 22 | 21 | 20 |
| W20 | 13 | 24 | 23 | 22 | | 20 |
| W21 | 13 | | 23 | 22 | 21 | 20 |
| W22 | 13 | 24 | 23 | | 21 | 20 |
| W23 | | 24 | 23 | 22 | 21 | 20 |
| W24 | 13 | 24 | | 22 | 21 | 20 |

126F 120F

FIG. 18

OPPOSING TWILLS AT MIRROR ANGLES

| | 1 | 2 | 3 | 4 | 5 | 6 | 1 | 2 | 3 | 4 | 5 | 6 |
|---|---|---|---|---|---|---|---|---|---|---|---|---|
| W1 | 1 | 2 | 3 | 4 | | 6 | 1 | 2 | 3 | 4 | | 6 |
| W2 | 1 | | 3 | 4 | 5 | 6 | 1 | | 3 | 4 | 5 | 6 |
| W3 | 1 | 2 | 3 | 4 | 5 | | 1 | 2 | 3 | 4 | 5 | |
| W4 | 1 | 2 | | 4 | 5 | 6 | 1 | 2 | | 4 | 5 | 6 |
| W5 | | 2 | 3 | 4 | 5 | 6 | | 2 | 3 | 4 | 5 | 6 |
| W6 | 1 | 2 | 3 | | 5 | 6 | 1 | 2 | 3 | | 5 | 6 |
| W7 | 1 | | 3 | 4 | 5 | 6 | 1 | | 3 | 4 | 5 | 6 |
| W8 | 1 | 2 | 3 | 4 | | 6 | 1 | 2 | 3 | 4 | | 6 |
| W9 | 1 | 2 | | 4 | 5 | 6 | 1 | 2 | | 4 | 5 | 6 |
| W10 | 1 | 2 | 3 | 4 | 5 | | 1 | 2 | 3 | 4 | 5 | |
| W11 | 1 | 2 | 3 | | 5 | 6 | 1 | 2 | 3 | | 5 | 6 |
| W12 | | 2 | 3 | 4 | 5 | 6 | | 2 | 3 | 4 | 5 | 6 |
| W13 | 1 | 2 | 3 | 4 | | 6 | 1 | 2 | 3 | 4 | | 6 |
| W14 | 1 | | 3 | 4 | 5 | 6 | 1 | | 3 | 4 | 5 | 6 |
| W15 | 1 | 2 | 3 | 4 | | 6 | 1 | 2 | 3 | 4 | | 6 |
| W16 | | 2 | 3 | 4 | 5 | 6 | | 2 | 3 | 4 | 5 | 6 |
| W17 | 1 | 2 | 3 | | 5 | 6 | 1 | 2 | 3 | | 5 | 6 |
| W18 | 1 | 2 | 3 | 4 | 5 | | 1 | 2 | 3 | 4 | 5 | |
| W19 | 1 | 2 | | 4 | 5 | 6 | 1 | 2 | | 4 | 5 | 6 |
| W20 | 1 | 2 | 3 | 4 | | 6 | 1 | 2 | 3 | 4 | | 6 |
| W21 | 1 | | 3 | 4 | 5 | 6 | 1 | | 3 | 4 | 5 | 6 |
| W22 | 1 | 2 | 3 | | 5 | 6 | 1 | 2 | 3 | | 5 | 6 |
| W23 | | 2 | 3 | 4 | 5 | 6 | | 2 | 3 | 4 | 5 | 6 |
| W24 | 1 | 2 | | 4 | 5 | 6 | 1 | 2 | | 4 | 5 | 6 |
| W1 | 1 | 2 | 3 | 4 | | 6 | 1 | 2 | 3 | 4 | | 6 |
| W2 | 1 | | 3 | 4 | 5 | 6 | 1 | | 3 | 4 | 5 | 6 |
| W3 | 1 | 2 | 3 | 4 | 5 | | 1 | 2 | 3 | 4 | 5 | |
| W4 | 1 | 2 | | 4 | 5 | 6 | 1 | 2 | | 4 | 5 | 6 |
| W5 | | 2 | 3 | 4 | 5 | 6 | | 2 | 3 | 4 | 5 | 6 |
| W6 | 1 | 2 | 3 | | 5 | 6 | 1 | 2 | 3 | | 5 | 6 |
| W7 | 1 | | 3 | 4 | 5 | 6 | 1 | | 3 | 4 | 5 | 6 |
| W8 | 1 | 2 | 3 | 4 | | 6 | 1 | 2 | 3 | 4 | | 6 |
| W9 | 1 | 2 | | 4 | 5 | 6 | 1 | 2 | | 4 | 5 | 6 |
| W10 | 1 | 2 | 3 | 4 | 5 | | 1 | 2 | 3 | 4 | 5 | |
| W11 | 1 | 2 | 3 | | 5 | 6 | 1 | 2 | 3 | | 5 | 6 |
| W12 | | 2 | 3 | 4 | 5 | 6 | | 2 | 3 | 4 | 5 | 6 |
| W13 | 1 | 2 | 3 | 4 | | 6 | 1 | 2 | 3 | 4 | | 6 |
| W14 | 1 | | 3 | 4 | 5 | 6 | 1 | | 3 | 4 | 5 | 6 |
| W15 | 1 | 2 | 3 | 4 | | 6 | 1 | 2 | 3 | 4 | | 6 |
| W16 | | 2 | 3 | 4 | 5 | 6 | | 2 | 3 | 4 | 5 | 6 |
| W17 | 1 | 2 | 3 | | 5 | 6 | 1 | 2 | 3 | | 5 | 6 |
| W18 | 1 | 2 | 3 | 4 | 5 | | 1 | 2 | 3 | 4 | 5 | |
| W19 | 1 | 2 | | 4 | 5 | 6 | 1 | 2 | | 4 | 5 | 6 |
| W20 | 1 | 2 | 3 | 4 | | 6 | 1 | 2 | 3 | 4 | | 6 |
| W21 | 1 | | 3 | 4 | 5 | 6 | 1 | | 3 | 4 | 5 | 6 |
| W22 | 1 | 2 | 3 | | 5 | 6 | 1 | 2 | 3 | | 5 | 6 |
| W23 | | 2 | 3 | 4 | 5 | 6 | | 2 | 3 | 4 | 5 | 6 |
| W24 | 1 | 2 | | 4 | 5 | 6 | 1 | 2 | | 4 | 5 | 6 |

100F

120F

126F

126F

FIG. 19

12x24 BALANCED TWILL WEAVE

| | 1 | 2 | 3 | 4 | 5 | 6 | 7 | 8 | 9 | 10 | 11 | 12 |
|---|---|---|---|---|---|---|---|---|---|---|---|---|
| W1 | 1 | 2 | 3 | 4 | 5 | 6 | 7 | 8 | 9 | 10 | 11 | 12 |
| W2 | 1 | 2 | 3 | 4 | 5 | 6 | 7 | 8 | 9 | 10 | 11 | 12 |
| W3 | 1 | 2 | 3 | 4 | 5 | 6 | 7 | 8 | 9 | 10 | 11 | 12 |
| W4 | 1 | 2 | 3 | 4 | 5 | 6 | 7 | 8 | 9 | 10 | 11 | 12 |
| W5 | 1 | 2 | 3 | 4 | 5 | 6 | 7 | 8 | 9 | 10 | 11 | 12 |
| W6 | 1 | 2 | 3 | 4 | 5 | 6 | 7 | 8 | 9 | 10 | 11 | 12 |
| W7 | 1 | 2 | 3 | 4 | 5 | 6 | 7 | 8 | 9 | 10 | 11 | 12 |
| W8 | 1 | 2 | 3 | 4 | 5 | 6 | 7 | 8 | 9 | 10 | 11 | 12 |
| W9 | 1 | 2 | 3 | 4 | 5 | 6 | 7 | 8 | 9 | 10 | 11 | 12 |
| W10 | 1 | 2 | 3 | 4 | 5 | 6 | 7 | 8 | 9 | 10 | 11 | 12 |
| W11 | 1 | 2 | 3 | 4 | 5 | 6 | 7 | 8 | 9 | 10 | 11 | 12 |
| W12 | 1 | 2 | 3 | 4 | 5 | 6 | 7 | 8 | 9 | 10 | 11 | 12 |
| W13 | 1 | 2 | 3 | 4 | 5 | 6 | 7 | 8 | 9 | 10 | 11 | 12 |
| W14 | 1 | 2 | 3 | 4 | 5 | 6 | 7 | 8 | 9 | 10 | 11 | 12 |
| W15 | 1 | 2 | 3 | 4 | 5 | 6 | 7 | 8 | 9 | 10 | 11 | 12 |
| W16 | 1 | 2 | 3 | 4 | 5 | 6 | 7 | 8 | 9 | 10 | 11 | 12 |
| W17 | 1 | 2 | 3 | 4 | 5 | 6 | 7 | 8 | 9 | 10 | 11 | 12 |
| W18 | 1 | 2 | 3 | 4 | 5 | 6 | 7 | 8 | 9 | 10 | 11 | 12 |
| W19 | 1 | 2 | 3 | 4 | 5 | 6 | 7 | 8 | 9 | 10 | 11 | 12 |
| W20 | 1 | 2 | 3 | 4 | 5 | 6 | 7 | 8 | 9 | 10 | 11 | 12 |
| W21 | 1 | 2 | 3 | 4 | 5 | 6 | 7 | 8 | 9 | 10 | 11 | 12 |
| W22 | 1 | 2 | 3 | 4 | 5 | 6 | 7 | 8 | 9 | 10 | 11 | 12 |
| W23 | 1 | 2 | 3 | 4 | 5 | 6 | 7 | 8 | 9 | 10 | 11 | 12 |
| W24 | 1 | 2 | 3 | 4 | 5 | 6 | 7 | 8 | 9 | 10 | 11 | 12 |

120J

126J

126J

FIG. 26

12x12 BALANCED TWILL WEAVE

| | 1 | 2 | 3 | 4 | 5 | 6 | 7 | 8 | 9 | 10 | 11 | 12 |
|---|---|---|---|---|---|---|---|---|---|---|---|---|
| W1 | 1 | 2 | 3 | 4 | 5 | 6 | 7 | 8 | 9 | 10 | 11 | 12 |
| W2 | 1 | 2 | 3 | 4 | 5 | 6 | 7 | 8 | 9 | 10 | 11 | 12 |
| W3 | 1 | 2 | 3 | 4 | 5 | 6 | 7 | 8 | 9 | 10 | 11 | 12 |
| W4 | 1 | 2 | 3 | 4 | 5 | 6 | 7 | 8 | 9 | 10 | 11 | 12 |
| W5 | 1 | 2 | 3 | 4 | 5 | 6 | 7 | 8 | 9 | 10 | 11 | 12 |
| W6 | 1 | 2 | 3 | 4 | 5 | 6 | 7 | 8 | 9 | 10 | 11 | 12 |
| W7 | 1 | 2 | 3 | 4 | 5 | 6 | 7 | 8 | 9 | 10 | 11 | 12 |
| W8 | 1 | 2 | 3 | 4 | 5 | 6 | 7 | 8 | 9 | 10 | 11 | 12 |
| W9 | 1 | 2 | 3 | 4 | 5 | 6 | 7 | 8 | 9 | 10 | 11 | 12 |
| W10 | 1 | 2 | 3 | 4 | 5 | 6 | 7 | 8 | 9 | 10 | 11 | 12 |
| W11 | 1 | 2 | 3 | 4 | 5 | 6 | 7 | 8 | 9 | 10 | 11 | 12 |
| W12 | 1 | 2 | 3 | 4 | 5 | 6 | 7 | 8 | 9 | 10 | 11 | 12 |

FIG. 28

GUIDING RESISTANT FORMING FABRIC WITH BALANCED TWILL MACHINE SIDE LAYER

FIELD OF THE INVENTION

The invention concerns forming fabrics for use in forming the initial embryonic web in a papermaking process. It is particularly concerned with composite forming fabrics comprised of two independent woven layers interconnected by pairs of binder weft yarns that together form two segments in each repeat of the binder weft pattern.

BACKGROUND OF THE INVENTION

Forming fabrics are known which have weave designs having two independent woven layers which are interconnected during weaving by a plurality of binder weft yarns. The binder yarns are woven as pairs such that, while a first pair member forms (or completes) the continuous unbroken weave pattern of the of non-binding weft yarns in the paper side (PS) layer, the second member interlaces with at least one warp yarn from the machine side (MS) layer so as to bind that layer to the PS layer. The pair members then exchange position (being directed during weaving from one layer to the other) so that the second member then continues the PS layer weave pattern so that it is unbroken and continuous while the first interlaces with a second, different warp yarn from the MS layer. Each exchange forms a segment of the continuous unbroken PS weave pattern. Such fabrics are known and have been described in U.S. Pat. No. 5,826,627 (Seabrook et al.) and others. Each binder yarn is said to be "intrinsic" in that it contributes to and is part of the PS surface pattern; additionally, each contributes to the interconnection of the PS and MS layers. Fabrics of this type are known as "SSB" or "sheet support binder" type forming fabrics in the papermaking arts.

While satisfactory in many respects, there is always a desire to improve on what has been done previously. The present invention is directed to resolving some of the shortcomings of the known prior art fabrics, particularly with respect to fabric guiding on a paper machine which is influenced by the MS layer contact surface. With certain twills, on the MS layer contact side, guiding can be an issue as the fabric tends to displace in the cross direction based on the twill. In view of this, it would be desirable to provide a forming fabric that addresses this and other issues.

SUMMARY

A forming fabric for a papermaking machine woven according to a repeating fabric weave pattern is provided. The fabric includes a PS layer having a PS surface, with the PS layer including PS warps and PS wefts interwoven in a first repeating pattern, and a MS layer having a MS surface, with the MS layer including interwoven MS warps and MS wefts. A plurality of pairs of binder weft yarns is provided, with each of the pairs of binder weft yarns comprising first and second binder weft yarns that are interwoven according to a binder weft pattern with the PS warps and the MS warps to bind the PS and MS layers together in the composite forming fabric, and each interchanges between the layers at exchange points. In each pattern repeat of the fabric weave pattern:

(a) each of the MS warps forms one or more MS warp knuckles over single ones of the MS wefts, (b) the MS warp knuckles of the MS warps are arranged in a broken twill having an offset mirror symmetric arrangement, and (c) a direction of the broken twill reverses after an equal number of MS warp knuckles.

In the preferred arrangements, each pair of twills form opposing equal angles crossing an equal number of MS wefts.

Preferably, an interweaving pattern of each of the binder weft yarn pairs in the PS layer forms a part of the first repeating pattern.

In a preferred arrangement, a ratio of a number of PS weft yarns, including allowing for pairs of the binder weft yarns, to a number of MS weft yarns is in a range from 1:1 to 3:1 in one said pattern repeat of the fabric weave pattern.

The cross-sectional shape of at least some of the warps, the wefts, and/or the binder yarns is selected from one of: generally circular, ovate, elliptical, square or rectangular. In some preferred arrangements, the PS warps are rectangular or ovate and the MS warps are also rectangular or ovate.

The PS warps, the PS wefts, the MS warps, the MS wefts and the binder weft yarns are preferably polymeric yarns made from at least one material selected from PET, PA, PBT, PEN, PPS or PEEK.

Fabrics made in accordance with the teachings of the invention will be heatset, processed, seamed, and finished in a manner using techniques and equipment similar to that used with other known SSB type fabrics.

BRIEF DESCRIPTION OF THE SEVERAL VIEWS OF THE DRAWINGS

The foregoing summary as well as the following detailed description will be best understood when read in conjunction with the appended drawings. In the drawings:

FIG. 6 is a partial weave diagram of a conventional MS layer twill weave diagram of a 3×3 twill, FIG. 7 is a partial weave diagram of a second embodiment of a MS layer 3×6 balanced twill weave that is used in SSB forming fabrics according to the invention, FIG. 8 is a view showing multiple repeats of the second embodiment of a MS layer 3×6 balanced twill weave of FIG. 7 creating an offset broken twill with opposing twills at the MS layer contact surface, FIG. 9 is a partial weave diagram of a conventional MS layer twill weave diagram of a 4×4 twill, FIG. 18 is a partial weave diagram of a seventh embodiment of a MS layer 6×24 balanced double twill weave that is used in SSB forming fabrics according to the invention, FIG. 19 is a view showing multiple repeats of the seventh embodiment of a MS layer 6×24 balanced double twill weave of FIG. 18 creating an offset broken twill with opposing twills at the MS layer contact surface, FIG. 26 is a partial weave diagram of an eleventh embodiment of a MS layer 12×24 balanced twill weave that is used in SSB forming fabrics according to the invention, FIG. 28 is a partial weave diagram of a twelfth embodiment of a MS layer 12×12 balanced twill weave that is used in SSB forming fabrics according to the invention.

DETAILED DESCRIPTION OF THE PREFERRED EMBODIMENTS

Figure 1:
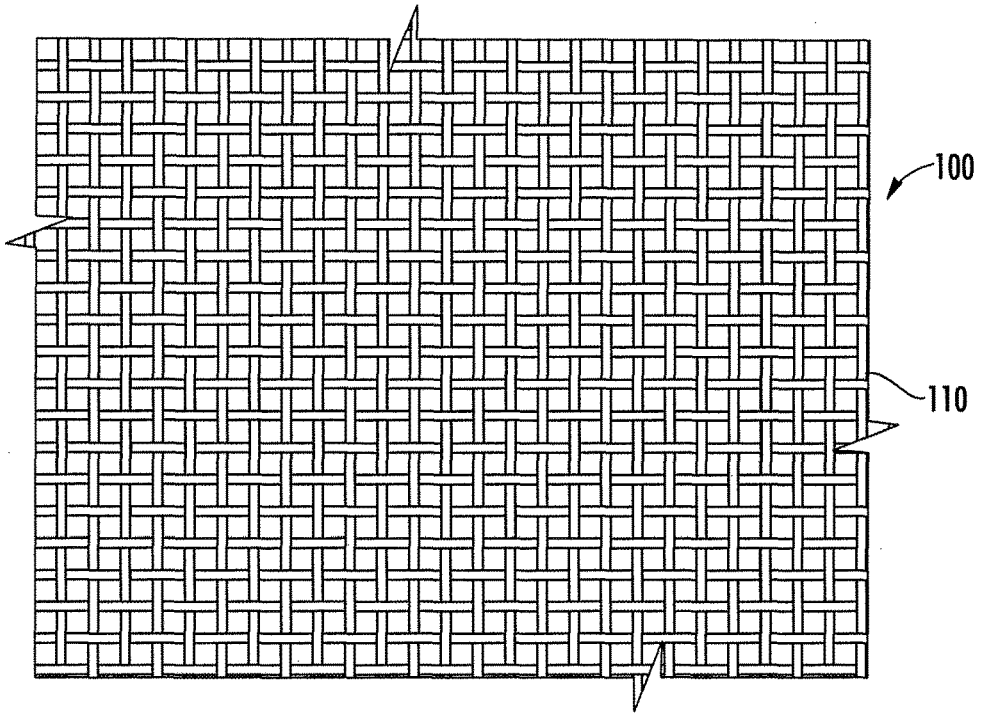
FIG. 1 is a photograph of the PS of a first embodiment of a SSB papermakers forming fabric according to the invention.
Figure 2:
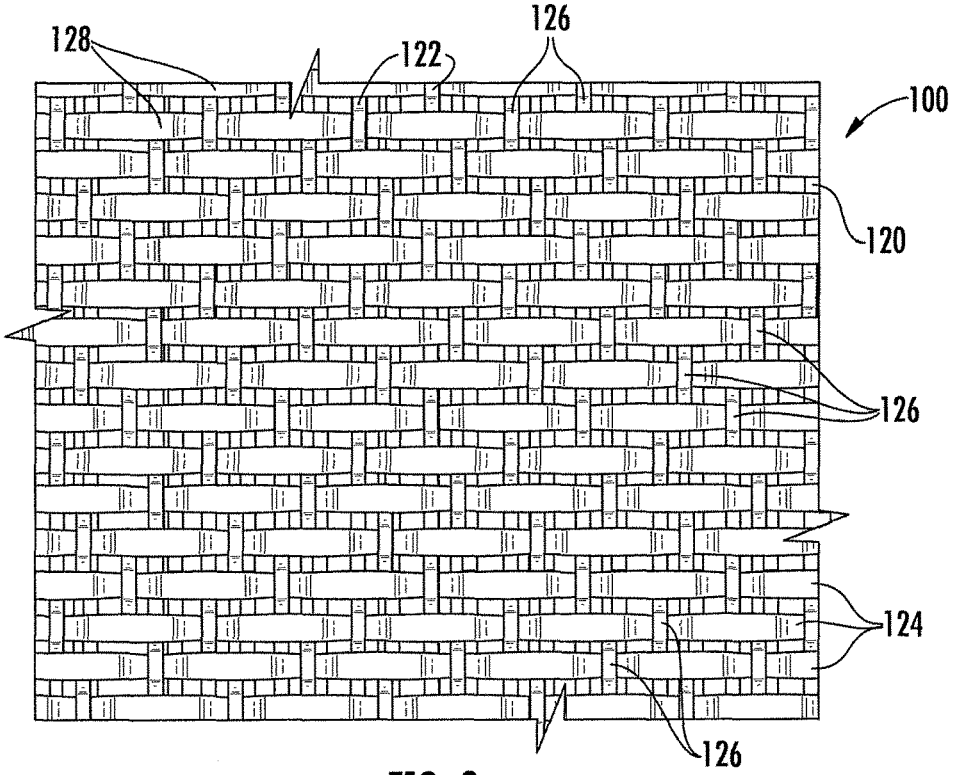
FIG. 2 is a photograph of the MS of the first embodiment of the SSB fabric shown in FIG. 1.

FIGS. 1 and 2 show PS and MS layers 110, 120, respectively, of a SSB forming fabric 100 according to the invention. The PS layer 110 includes PS warps interwoven with PS wefts in a PS repeating pattern. The MS layer 120 includes MS warps 122 interwoven with MS wefts 124 in a MS repeating pattern. As can be seen from FIG. 2, in particular, each of the MS warps 122 forms one or more MS warp knuckles 126 over single ones of the MS wefts 124. All of the MS warp knuckles 126 are single warp knuckles and do not extend over more than 1 MS weft 124. The MS wefts 124 form MS weft floats 128 over the MS warps 122, the MS warp knuckles 126 are arranged in a broken twill having an offset mirror symmetric arrangement. As can be generally seen in FIG. 2, a direction of the broken twill reverses after an equal number of MS warp knuckles 126.

Figure 3:
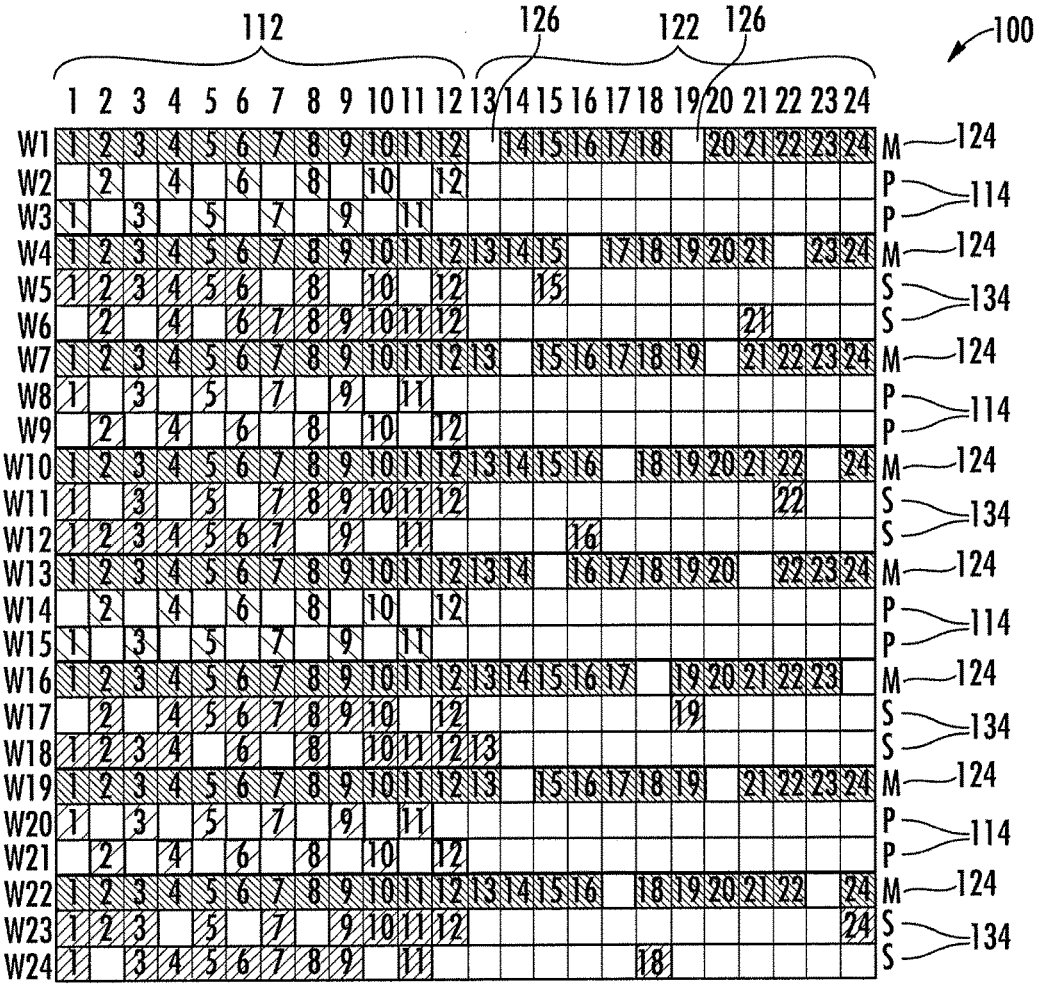
FIG. 3 is a weave diagram of the SSB fabric according to FIG. 1 which provides an offset broken twill with opposing twills at the MS layer contact surface.
Figure 4:
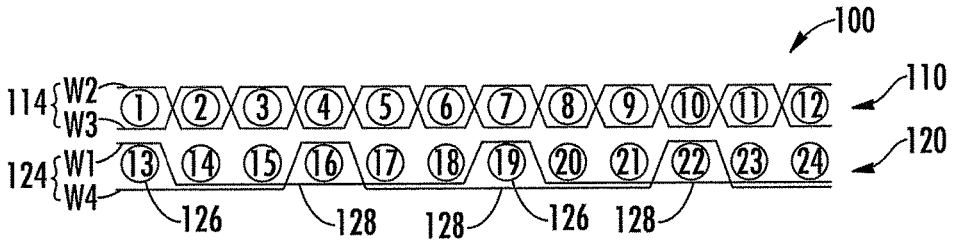
FIG. 4 is a cross-sectional schematic view through the warp yarns of the fabric of FIG. 3 showing the weave paths of the first four weft yarns.
Figure 5:
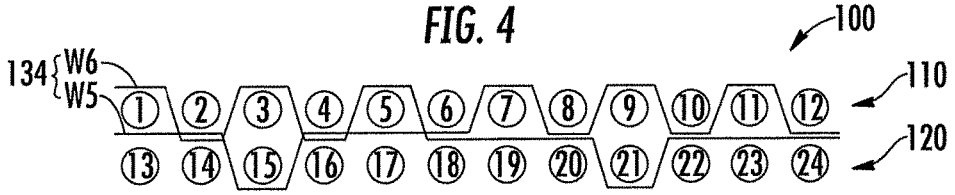
FIG. 5 is a cross-sectional schematic view through the warp yarns of the fabric of FIG. 3 showing the weave paths of the fifth and sixth weft yarns that form the first binder pair of weft yarns.

FIG. 3 is a weave diagram of a SSB forming fabric 100, with schematic cross-sections being shown in FIGS. 4 and 5. The PS warp yarns 112 are individually numbered 1-12 and the MS warp yarns 122 are individually numbered 13 to 24 across the top of the diagram, and the MS weft yarns 124 are individually numbered W1 to W24 along the left side of the diagram, and include a combination of PS weft yarns, generally indicated as 114, MS weft yarns, generally indicated as 124, and binder weft yarns, generally indicated as 134. Locations where a weft yarn passes over a warp yarn are indicated by a white (blank) square in the pattern. In the first embodiment of fabric 100, the PS layer 110 has a PS surface, with the PS layer 110 including the PS warps 1 to 12 and non-binding PS weft yarns W2,W3,W8,W9,W14, W15,W20,W21 (indicated as wefts "P" at the right side of the weave diagram) interwoven in a first repeating pattern, and the MS layer 120 has a MS surface, with the MS layer 120 including interwoven MS warps 13 to 24 and non-binding MS wefts W1,W4,W7,W10,W13,W16,W19,W22 (indicated as wefts "M" at the right side of the weave diagram). A plurality of pairs of binder weft yarns 134 is provided, with each of the pairs of binder weft yarns comprising first and second binder weft yarns W5,W6;W11, W12;W17,W18;W23,W24 (indicated as wefts "S" at the right side of the weave diagram) that are interwoven according to a binder weft pattern with the PS warps 1-12 and the MS warps 13-24 to bind the PS and MS layers 110, 120 together to form the SSB forming fabric 100.

In FIG. 4, the interweaving pattern of the first two PS weft yarns W2, W3 as well as the first two MS weft yarns W1, W4 with the PS warps 1-12 and the MS warps 13-24, respectively, are shown. The PS weft yarns W2, W3 interweave with the PS warp yarns 1-12 in a 2 shed (plain weave) as per the weave diagram in FIG. 4. However, other weaves such as a 3, 4, or 6 shed twill, broken twill, satin, etc. could be used as will be understood by those skilled in the art. The MS wefts W1, W4 have long MS floats 128 on the MS surface of the fabric 100. In the illustrated embodiment, the floats are under 5 of the MS warps 13-24. This protects the MS warp yarns from excessive wear.

In order to achieve the benefits of the present fabric 100, each weave repeat provides a balanced weave, where each of the MS warps 13-24 forms one or more of the MS warp knuckles 126 over single ones of the MS wefts W1,W4,W7, W10,W13,W16,W19,W22, and the MS warp knuckles 126 of the MS warps 13-24 are arranged in a broken twill, with one or more pairs of twill lines, having an offset mirror symmetric arrangement with a direction of the broken twill reversing after an equal number of MS warp knuckles 126.

Each pair of twills form opposing equal angles crossing an equal number of MS wefts 124. The MS wefts 124 in the 2nd half of the weave pattern do not necessarily form a mirror image of the preceding 1st half of the weave. Specifically, instead of being a mirror symmetric arrangement in which W13, W16, W19, and W22 would have the same weft path as W10, W7, W4, and W1, respectively, the invention provides that the broken twill is offset so that the reversed areas of the twill are not exactly mirror symmetric, which can be seen more clearly in the MS layer 120 weave diagrams in the embodiments that follow where the reversed twill lines do not meet at the reversal point of the twill from right-to-left to left-to-right, and instead are offset.

Further, each of the MS warps 13-24 in a repeat interlaces with at least one, and preferably up to four, single, non-adjacent ones of the MS wefts 1,4,7,10,13,16,19,22 forming the MS warp knuckles 126. In the first embodiment of the fabric 100, there is preferably at least one and no more than two MS warp knuckles 126 on each of the MS warps 13-24 in a repeat, and the MS warp knuckles 126 are spaced apart on a single MS warp by three or more MS wefts 124.

Each pair of the weft binder yarns 134, such as W5, W6 shown in FIG. 5, are interwoven with the PS warp yarns 1-12 such that together the paths of the two binder weft yarns as they interweave in the PS layer 110 is an analogue of that of an adjacent, but non-binding, weft yarn that follows the PS weave pattern repeat. In the illustrated example in FIG. 3, this is a plain weave.

The interweaving pattern of the first pair of binder weft binder yarns W5 and W6 in FIG. 5 is shown by following the paths of the weave diagram of FIG. 3. Reading from the left, the binder weft yarn W5 passes under warps 1-6, over 7, under 8, over 9, under 10, over 11 and under 12 to complete a first binder weft path in the PS surface. The binder weft yarn W5 also passes beneath MS warp 15 to bind the MS and PS layers together. The binder weft yarn W6 passes over warp 1, under 2, over 3, under 4, over 5, and under warps 6-12 to complete the second binder weft path in the PS surface. Binder weft yarn W6 also passes beneath MS warp 21 to bind the MS and PS layers together. The paths of the remaining weft binder yarns are shown by the weave diagram in FIG. 3.

Fabrics 100 woven according to the pattern shown in FIG. 3 will have 8 PS weft yarns, 8 binder weft yarns arranged as four pairs (acting effectively as 4 PS weft yarns), and 8 MS weft yarns in each repeat of the weft yarns. The pattern shown will provide a fabric in which the ratio of PS weft yarns to MS weft yarns is effectively 3:2 (meaning there are effectively 12 PS wefts and 8 MS wefts in the pattern repeat). In other arrangements according to the invention, this can vary and a ratio of a number of PS weft yarns 114, including allowing for pairs of the binder weft yarns 134, to a number of MS weft yarns 124 is in a range from 1:1 to 3:1 in one said pattern repeat of the fabric weave pattern. A ratio of a number of PS warp yarns to a number of MS warp yarns is preferably in a range from 1:3 to 2:1 in one said pattern repeat of the fabric weave pattern. In the preferred embodiments, the fabrics will have a 1:1 warp ratio, with the PS and MS warps preferably being stacked. However, other ratios can be used for PS weft yarns to MS weft yarns as well as the PS warp yarns 1-12 and MS warp yarns 13-24. As shown, the number of MS wefts 124 in a weave pattern is an integer multiple of the number of MS warps 122. However, other arrangements may be possible, as discussed in further detail below.

The first embodiment of the fabric 100 is preferably woven in a 24 shed weave. However, depending on the specific weave pattern, a different number of sheds could be used.

Preferably the warps, the wefts, and/or the binder yarns are made of a polymeric material, and may be monofilaments or multifilaments. The polymeric yarns are preferably made from at least one material selected from PET, PA, PBT, PEN, PPS or PEEK, or any other suitable hydrolysis resistant polymer having the desired strength and flexibility. The PS warps 1-12 preferably are round and have a diameter of 0.05 to 0.8 mm. They could also be ovate, elliptical, square or rectangular. The MS warp yarns 13-24 are preferably also round and have a diameter of 0.05 to 0.8 mm. They could also be ovate, elliptical, square or rectangular. Preferably, the MS warps 13-24 have a larger diameter than the PS warps 1-12. The PS wefts W2,W3,W8,W9,W14,W15, W20, W21 are round and have a diameter of 0.05 to 0.8 mm. They could also be ovate, elliptical, square or rectangular. The MS wefts W1,W4,W7,W10,W13,W16,W19,W22 as well as the MS binder yarns W5,W6,W11,W12,W17,W18,W23,W24 are preferably also round and have a diameter of 0.18 to 0.8 mm. They could also be ovate, elliptical, square or rectangular.

Referring to FIG. 6, a prior art 3×3 twill arrangement is shown demonstrating the known twill.

FIGS. 7 and 8 are a weave diagram showing only a repeat of the MS layer 120A of a second embodiment of an SSB forming fabric 100A according to the invention. In FIG. 7, a single 3×6 balanced twill weave repeat for the MS warp yarns 1, 2, 3 and the MS weft yarns W1-W6 are shown. Those skilled in the art will understand that FIGS. 7 and 8 only represent a portion of a weave diagram for a complete fabric, such as shown in FIG. 3. This machine side layer 120A will be combined with a PS layer, similar to the layer 110 above using binding yarns, such as 134 above, to form an SSB forming fabric 100A in the known manner with the improvement according to the invention being in the MS warp knuckles 126A being arranged as a broken twill with an offset mirror symmetric arrangement with a direction of the broken twill reversing after an equal number of MS warp knuckles 126A. The advantage of the broken twill with an offset mirror arrangement is that the MS warp knuckles 126 that would otherwise be formed along warp 3 and weft yarns W3 and W4 in a mirrored arrangement of FIG. 6 from being directly adjacent to one another since the twill arrangement is offset when it is mirrored. The broken twill is more clearly illustrated with the four repeats shown in FIG. 8. Here, each MS warp 1-3 in a repeat forms 2 MS warp knuckles 126 which are spaced apart from one another by 1-3 intermediate MS wefts W1-W6.

Referring to FIG. 9, a prior art 4×4 twill is shown.

Figure 10:
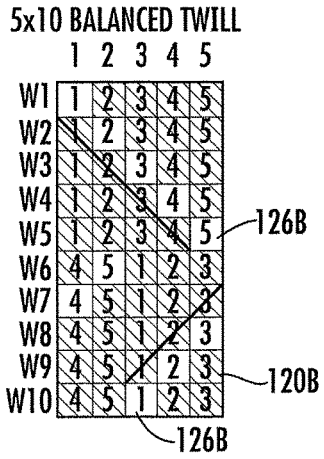
FIG. 10 is a partial weave diagram of a third embodiment of a MS layer 5×10 balanced twill weave that is used in SSB forming fabrics according to the invention.
Figure 11:
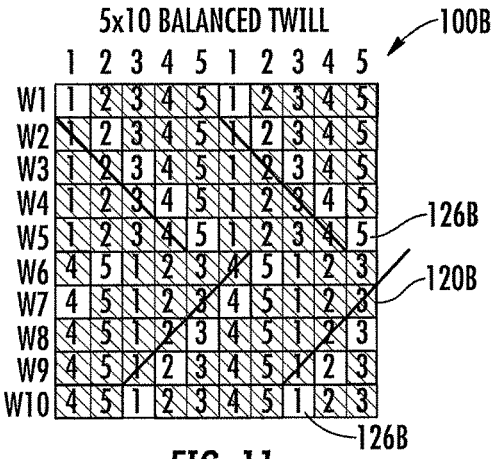
FIG. 11 is a view showing multiple repeats of the third embodiment of a MS layer 5×10 balanced twill weave of FIG. 10 creating an offset broken twill with opposing twills at the MS layer contact surface.

FIGS. 10 and 11 illustrate a third embodiment of the SSB forming fabric 100B in which the MS layer 120B is formed with a 5×10 balanced twill, a single repeat of which is shown in FIG. 10 and two repeats aligned with one another more clearly showing the arrangement of opposing twills is shown in FIG. 11. Here again, only the MS layer 120B is illustrated and a PS layer similar to PS layer 110 described in connection with the first embodiment of the SSB forming fabric 100 would be required with the two layers being interconnected by binder yarns such as binder yarns 134 described above. In this embodiment, the MS warp knuckles 126B are spaced apart from one another along each of the MS warps 1-5 by two to five intervening MS wefts W1-W10. This embodiment also provides a broken twill with an offset mirror symmetric arrangement, with a direction of the broken twill reversing after an equal number of MS warp knuckles 126B which eliminates the guiding issues with a regular twill MS layer contact surface with the machine side of papermaking machine.

Figure 12:
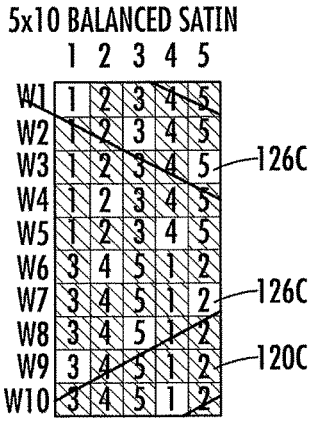
FIG. 12 is a partial weave diagram of a fourth embodiment of a MS layer 5×10 satin weave that is used in SSB forming fabrics according to the invention.
Figure 13:
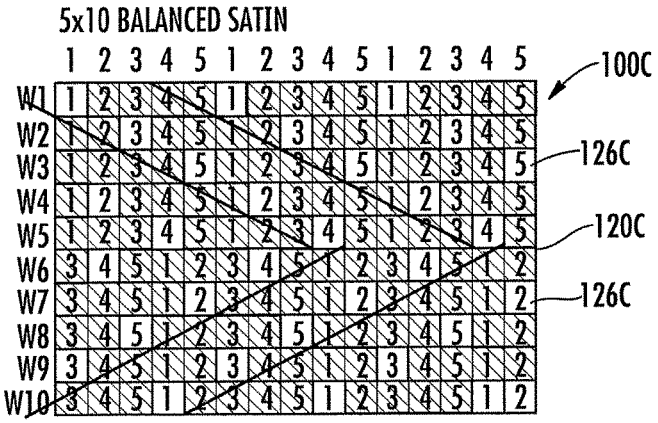
FIG. 13 is a view showing multiple repeats of the fourth embodiment of a MS layer 5×10 satin weave of FIG. 12 creating an offset broken twill with opposing twills at the MS layer contact surface.

Referring now to FIGS. 12 and 13, an MS layer 120C for an SSB forming fabric 100C according to a fourth embodiment of the present invention is shown. The MS layer 120C is woven with a 5×10 balanced satin weave. Here, the opposing twills formed by the MS warp knuckles 126C are shown more clearly by the multiple repeats shown in FIG. 13. Here again, the weave diagrams in FIGS. 12 and 13 only shown the MS layer 120C and this would be combined with a PS layer, such as PS layer 110 described above using pairs of binder weft yarns such as binder weft yarns 134 described above. In this embodiment, the MS warp knuckles 126C are spaced apart from one another along each of the MS warps 1-5 by one to seven intervening MS wefts W1-W10. This embodiment also provides a broken twill with an offset mirror symmetric arrangement, with a direction of the broken twill reversing after an equal number of MS warp knuckles 126C which eliminates the guiding issues with a regular twill MS layer contact surface with the machine side of papermaking machine.

Figure 14:
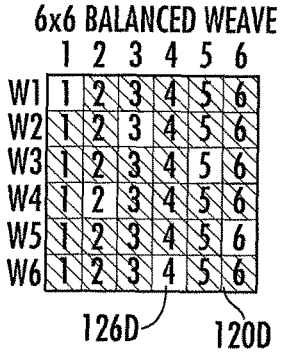
FIG. 14 is a partial weave diagram of a fifth embodiment of a MS layer 6×6 balanced twill weave that is used in SSB forming fabrics according to the invention.
Figure 15:
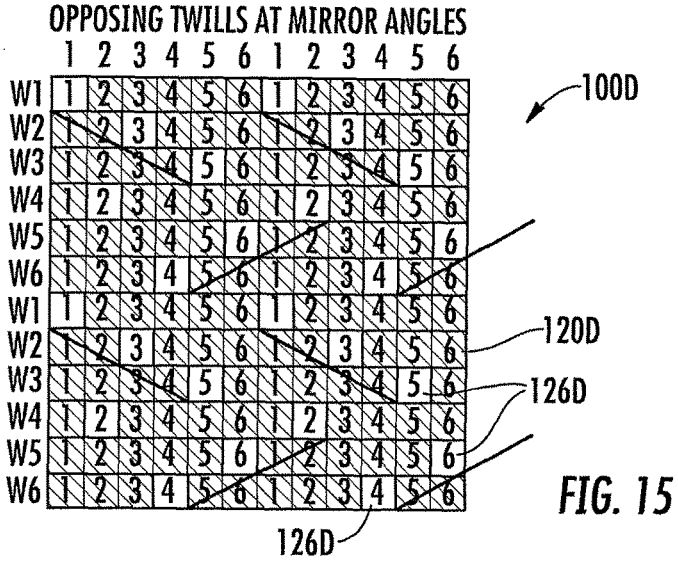
FIG. 15 is a view showing multiple repeats of the fifth embodiment of a MS layer 6×6 balanced twill weave of FIG. 14 creating an offset broken twill with opposing twills at the MS layer contact surface.

FIGS. 14 and 15 show an MS layer 120D for a fifth embodiment of an SSB forming fabric 100D according to the invention. In the fifth embodiment of the SSB forming fabric 100D, the MS layer 120D is woven with a 6×6 balanced weave as shown in FIG. 14, with FIG. 15 showing several repeats that illustrate the offset broken twill with the offset mirror symmetric arrangement and a direction of the broken twill reversing after an equal number of MS warp knuckles 126D. In this arrangement, there are five MS wefts W1-W6 located between the MS warp knuckles 126D on the MS layer 120D machine facing side, with the offset broken twill arrangement being clearly indicated by the twill lines in FIG. 15. Here again, the weave diagrams in FIGS. 14 and 15 only show the MS layer 120D and this would be combined with a PS layer, such as PS layer 110 described above using pairs of binder weft yarns such as binder weft yarns 134 described above.

Figure 16:
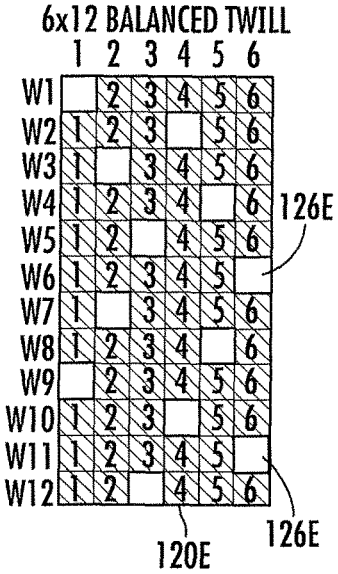
FIG. 16 is a partial weave diagram of a sixth embodiment of a MS layer 6×12 balanced twill weave that is used in SSB forming fabrics according to the invention.
Figure 17:
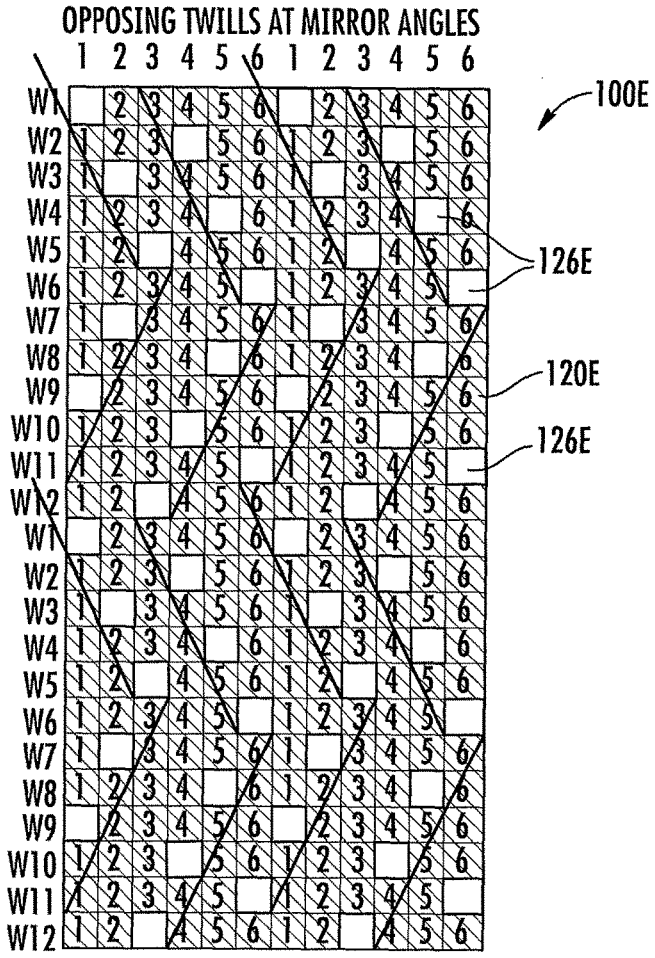
FIG. 17 is a view showing multiple repeats of the sixth embodiment of a MS layer 6×12 balanced double twill weave of FIG. 16 creating an offset broken twill with opposing twills at the MS layer contact surface.

Referring to FIGS. 16 and 17, the repeat for an MS layer 120E of a sixth embodiment of an SSB forming fabric 100E is shown. This arrangement provides an MS layer 120E with a 6×12 balanced twill having an offset mirror symmetric arrangement with a direction of the broken twill reversing after an equal number of MS warp knuckles 126E. A single repeat is shown in FIG. 16 where the spacing between adjacent MS warp knuckles 126E on each of the MS warps 1-6 is between 3 and 7 MS wefts W1-W12. The broken twill in an offset mirror symmetric arrangement is illustrated with the twill lines indicated in FIG. 17. Here again, the weave diagrams in FIGS. 16 and 17 only show the MS layer 120E and this would be combined with a PS layer, such as PS layer 110 described above using pairs of binder weft yarns such as binder weft yarns 134 described above.

Referring now to FIGS. 18 and 19, the MS layer 120F weave diagram for a seventh embodiment for an SSB forming fabric 100F is shown. In FIG. 18, a single repeat of the 6×24 balanced weave is shown with the MS warp knuckles 126F arranged in a broken twill having an offset mirror symmetric arrangement with a direction of the broken twill reversing after an equal number of MS warp knuckles 126F. The offset broken twill arrangement is shown more clearly with the multiple repeats shown in FIG. 19. The spacing between adjacent MS warp knuckles 126F on each of the MS warps 1-6 is between 3 and 9 MS wefts W1-W24. Those skilled in the art would understand that a PS layer, similar to the PS layer 110 described above would be connected to the MS layer 120F using binder yarns, such as the binder yarns 134 described above.

Figure 21:
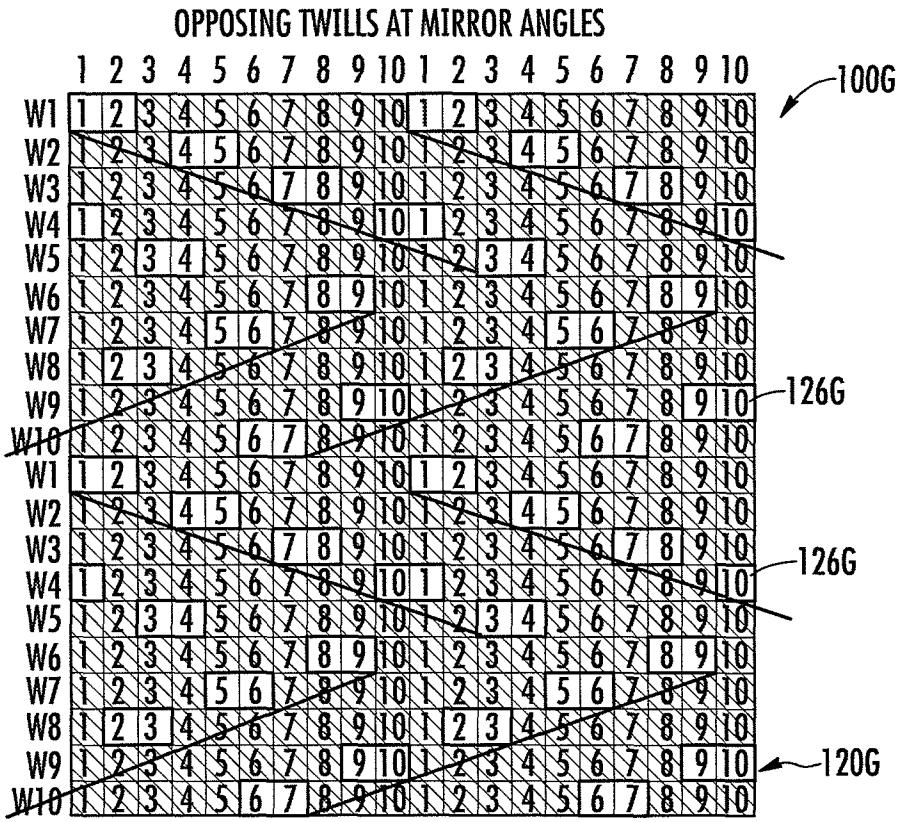
FIG. 21 is a view showing multiple repeats of the eighth embodiment of a MS layer 10×10 balanced twill weave of FIG. 20 creating an offset broken twill with opposing twills at the MS layer contact surface.
Figure 20:
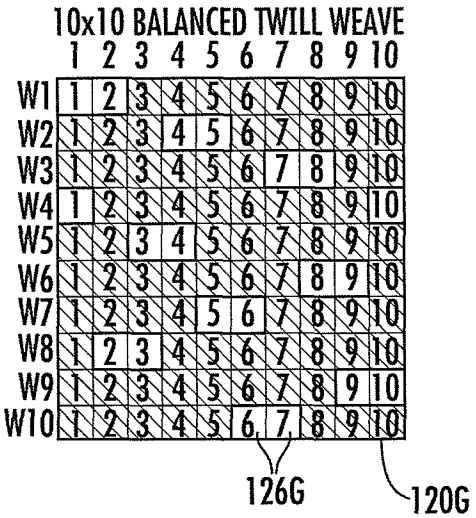
FIG. 20 is a partial weave diagram of an eighth embodiment of a MS layer 10×10 balanced twill weave that is used in SSB forming fabrics according to the invention.

Referring to FIGS. 20 and 21, an MS layer 120G for an SSB forming fabric 100G in accordance with an eighth embodiment of the invention is shown. In this case, as shown in FIG. 20, the MS layer 120 is formed with a 10×10 broken twill having an offset mirror symmetric arrangement with a direction of the broken twill reversing after an equal number of MS warp knuckles 126G. Here the MS warp knuckles 126G on each MS warp 1-10 are located adjacent to an MS warp knuckle 126G on an adjacent one of the MS warps 1-10, providing more distinct twill lines. FIG. 21 illustrates multiple repeats with the twill lines being indicated. Again, the MS layer 120G would be combined with a PS layer similar to the PS layer 110 described above by weft binder yarns, similar to the weft binder yarns 134 described above. In this case, the MS warp knuckles 126G are separated from one another along each of the MS warps 1-10 in a repeat by 2-6 intervening MS wefts W1-W10.

Figure 22:
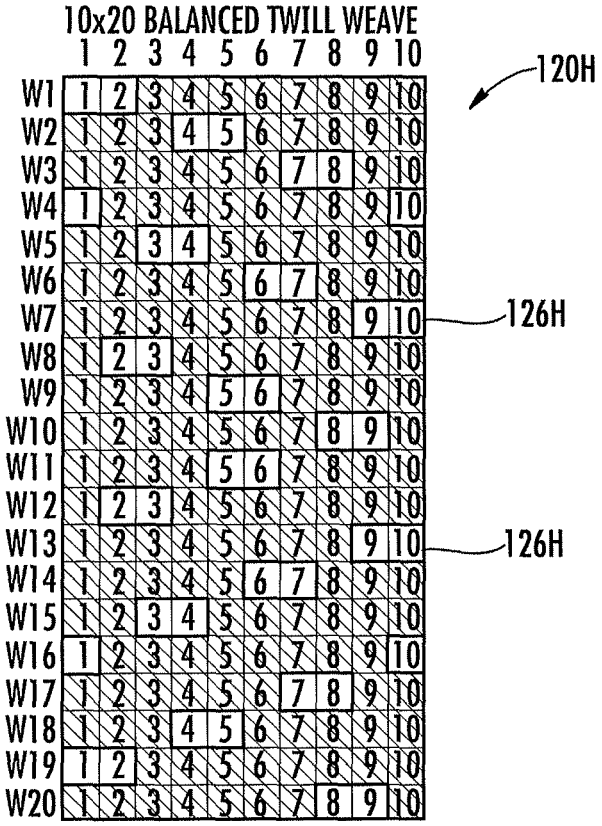
FIG. 22 is a partial weave diagram of a ninth embodiment of a MS layer 10×20 balanced twill weave that is used in SSB forming fabrics according to the invention.
Figure 23:
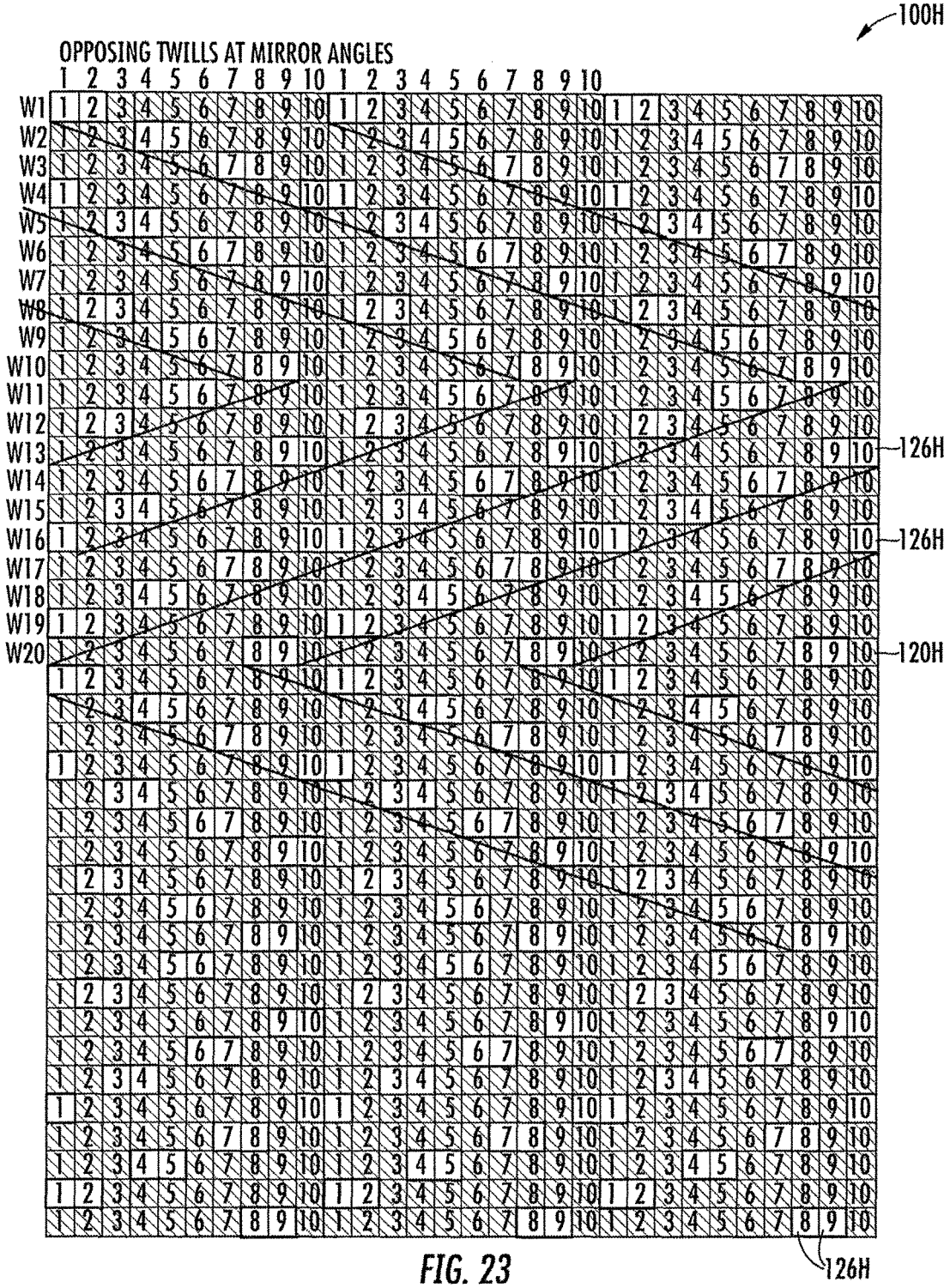
FIG. 23 is a view showing multiple repeats of the ninth embodiment of a MS layer 10×20 balanced twill weave of FIG. 22 creating an offset broken twill with opposing twills at the MS layer contact surface.

Referring to FIGS. 22 and 23, an MS layer 120H of an SSB forming fabric 100H according to a ninth embodiment of the invention is shown. Here, the MS layer is woven with a 10×20 balanced twill weave shown in FIG. 22 with the MS warp knuckles 126H arranged in a broken twill having an offset mirror symmetric arrangement with a direction of the twill reversing after an equal number of MS warp knuckles 126H. Here again, the MS warp knuckles 126H on each MS warp 1-10 are located adjacent to an MS warp knuckle 126H on an adjacent one of the MS warps 1-10, providing more distinct twill lines. FIG. 23 shows multiple repeats where the offset broken twill lines formed by the MS warp knuckles 126H are more clearly shown. The complete forming fabric 100H would also include a PS layer, similar to the PS layer 110 described above, connected to the MS layer 120H using binding yarns similar to the binding yarns 134 described above. Here, the MS warp knuckles 126H along a single MS warp 1-10 are spaced apart between 1 and 11 MS wefts W1-W20.

Figure 24:
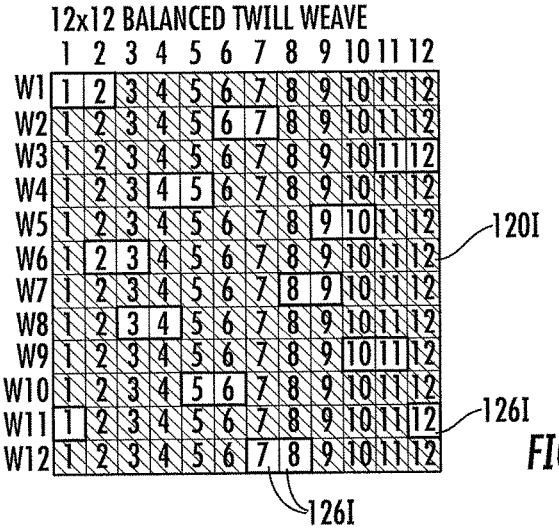
FIG. 24 is a partial weave diagram of a tenth embodiment of a MS layer 12×12 balanced twill weave that is used in SSB forming fabrics according to the invention.
Figure 25:
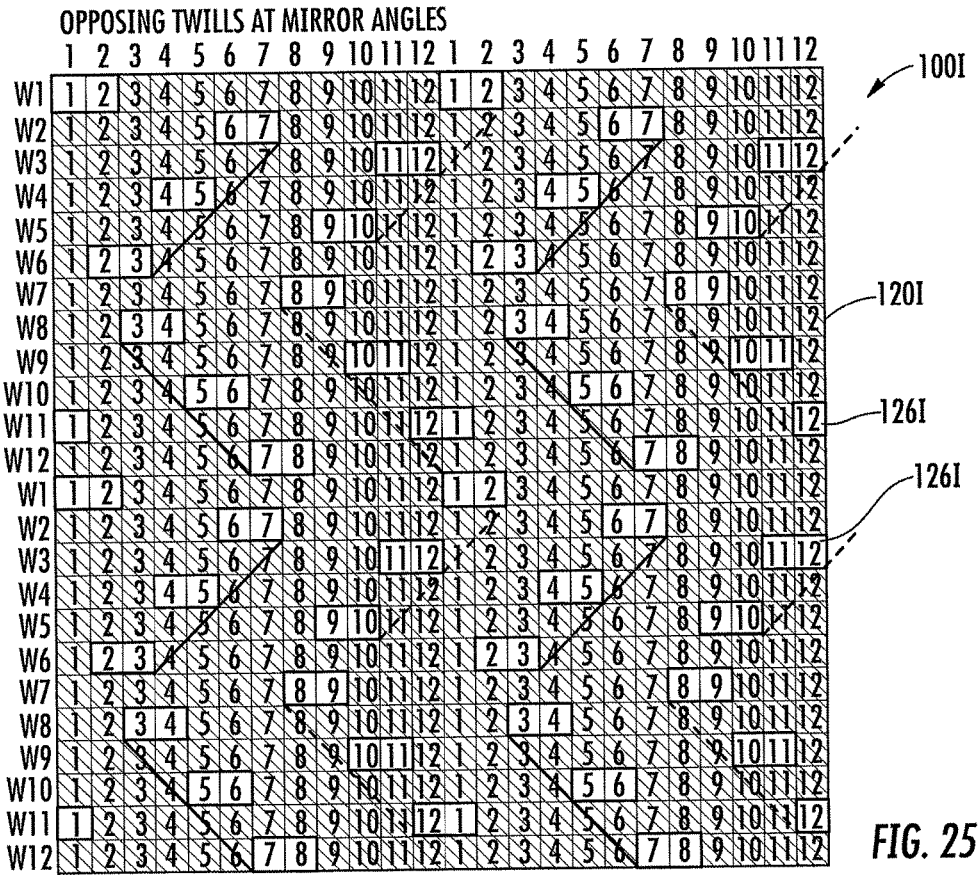
FIG. 25 is a view showing multiple repeats of the tenth embodiment of a MS layer 12×12 balanced twill weave of FIG. 24 creating an offset broken twill with opposing twills at the MS layer contact surface.

Referring now to FIGS. 24 and 25, the MS layer 120I of an SSB forming fabric 100I according to a tenth embodiment of the invention is shown. In this case, as shown in FIG. 24, the MS layer 120I is woven with a 12×12 balanced twill as a broken twill having an offset mirror symmetric arrangement with the direction of the broken twill reversing after an equal number of MS warp knuckles 126I. Here again, the MS warp knuckles 126I on each MS warp 1-12 are located adjacent to an MS warp knuckle 126I on an adjacent one of the MS warps 1-12, providing more distinct twill lines. As shown in FIG. 25, where multiple repeats are illustrated, the offset twill lines are created by the MS warp knuckles 126I are apparent. As in the previous embodiment, the SSB forming fabric 100I would also include a PS layer, similar to the PS layer 110 described above connected to the MS layer 120I using binder yarns, similar to the binder yarns 134 described above.

Figure 27:
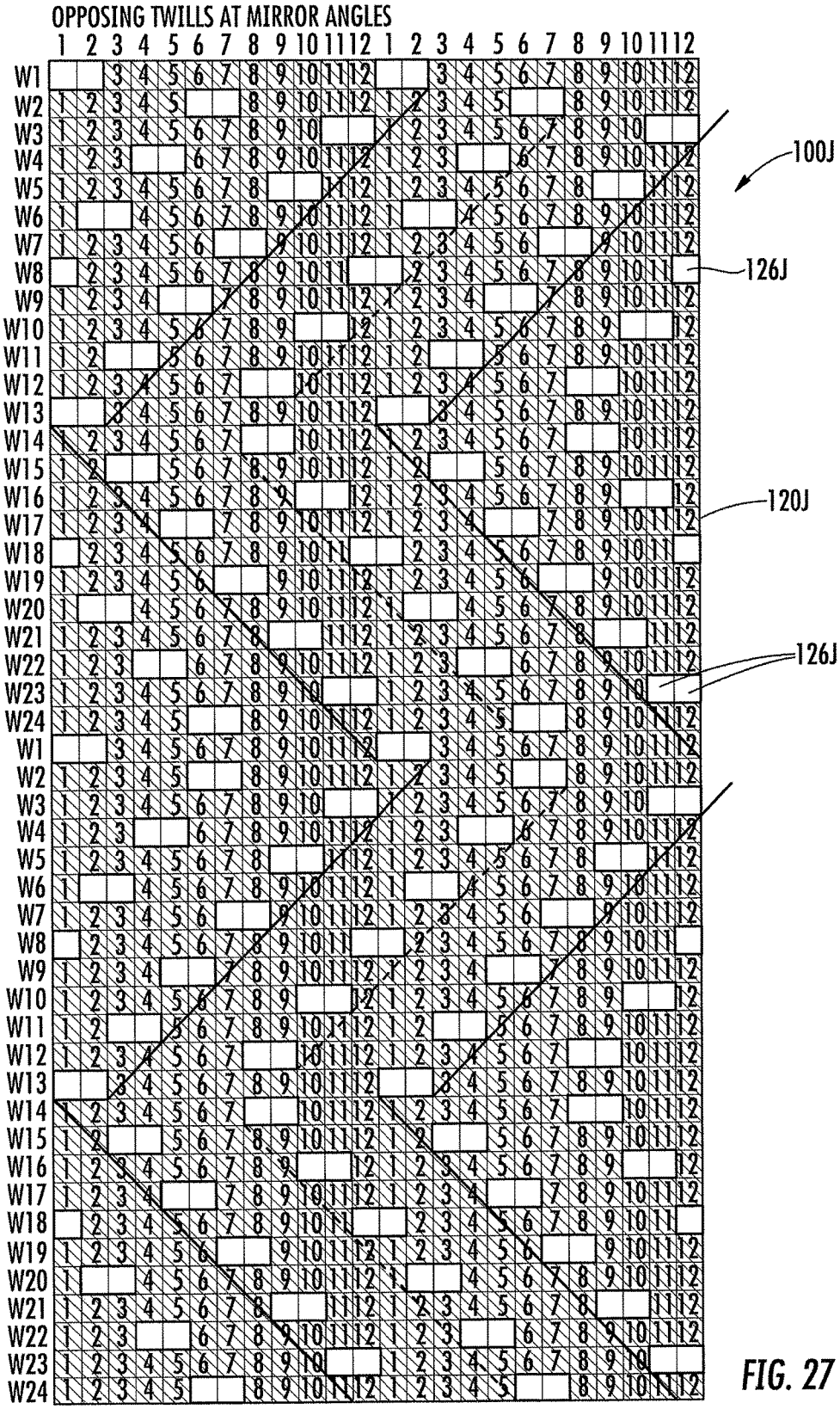
FIG. 27 is a view showing multiple repeats of the eleventh embodiment of a MS layer 12×24 balanced twill weave of FIG. 26 creating an offset broken twill with opposing twills at the MS layer contact surface.

Referring to FIGS. 26 and 27, an MS layer 120J for an SSB forming fabric 100J according to an eleventh embodiment of the invention is shown. In this embodiment, the MS layer 120 is woven with a 12×24 balanced twill weave as shown in FIG. 26 where the twill is a broken twill having an offset mirror symmetric arrangement with a direction of the broken twill reversing after an equal number of MS warp knuckles 126J. Here again, the MS warp knuckles 126J on each MS warp 1-12 are located adjacent to an MS warp knuckle 126J on an adjacent one of the MS warps 1-12. This provides a more distinct broken twill. As shown in FIG. 27, where multiple repeats of the MS layer 120J weave pattern are shown, this provides a distinct offset broken twill arrangement. Here the MS warp knuckles 126J are spaced apart by 1-11 intervening MS wefts 1-24. As in the above embodiments, the SSB forming fabric 100J would include a PS layer, similar to the PS layer 110 described above connected to the MS layer 120J by binder yarns, such as the binder yarns 134 described above.

Figure 29:
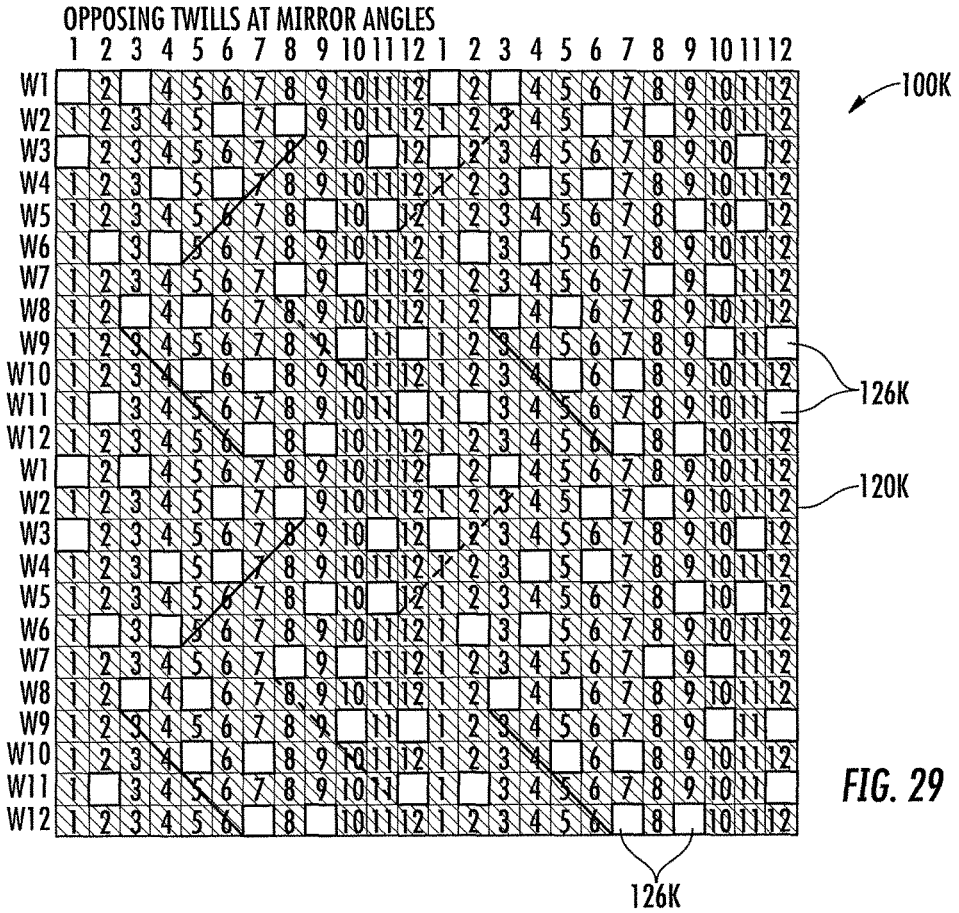
FIG. 29 is a view showing multiple repeats of the twelfth embodiment of a MS layer 12×12 balanced twill weave of FIG. 28 creating an offset broken twill with opposing twills at the MS layer contact surface.

Referring now to FIGS. 28 and 29, a MS layer 120K of an SSB forming fabric 100K according to a twelfth embodiment of the present invention is shown. FIG. 28 shows a single repeat with a 12×12 balanced weave with a broken twill having an offset mirror symmetric arrangement with a direction of the broken twill reversing after an equal number of MS warp knuckles 126K. FIG. 29 shows several repeats along with indicators for the offset broken twill lines formed by the MS warp knuckles 126K. The MS warp knuckles 126K along each MS warp 1-12 are spaced apart by between 1 and 9 intervening wefts W1-W12. In this arrangement, pairs of the MS warp knuckles 126K of MS warps 1-12 that are spaced apart from one another by a single MS warp 1-12 are located on each of the MS wefts W1-W12 in each said pattern repeat. The SSB forming fabric 100K would also include a PS layer, similar to the PS layer 110 discussed above that is connected to the MS layer 120K using binding weft yarns, such as the binder yarns 134 discussed above.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A forming fabric for a papermaking machine woven with a fabric weave pattern, comprising:

a PS layer having a PS surface, the PS layer including PS warps and PS wefts interwoven in a first repeating pattern, a MS layer having a MS surface, the MS layer including interwoven MS warps and MS wefts, a plurality of pairs of binder weft yarns, each of the pairs of binder weft yarns comprising first and second binder weft yarns that are interwoven according to a binder weft pattern with the PS warps and the MS warps to bind the PS layer and the MS layer together, each of the first and second binder weft yarns interchanges between the PS and MS layers at exchange points, and each said pair of binder weft yarns interweave with the PS warps with an interweaving pattern such that binder weft knuckles formed on the PS surface by said pair of binder weft yarns have a same pattern as weft knuckles of other ones of the PS wefts as part of the first repeating pattern to form a uniform PS surface, and in each pattern repeat of the fabric weave pattern:

(a) each of the MS warps forms one or more MS warp knuckles over single ones of the MS wefts, (b) the MS warp knuckles of the MS warps are arranged in a broken twill having an offset mirror symmetric arrangement, and (c) a direction of the broken twill reverses after an equal number of MS warp knuckles.

2. The fabric according to claim 1, wherein each pair of twills form opposing equal angles crossing an equal number of MS wefts.

3. The fabric according to claim 1, wherein the interweaving pattern of each of the binder weft yarn pairs in the PS layer results in each of the binder weft yarn pairs acting together as a single PS weft to form an unbroken interweaving pattern with the first repeating pattern with a same weave at the PS surface such that the binder yarn pairs complete part of the first repeating pattern.

4. The fabric according to claim 1, wherein the number of MS warps in one said pattern repeat of the fabric weave pattern is the same as a number of PS warps in the same pattern repeat.

5. The fabric according to claim 1, wherein a ratio of a number of PS wefts, including allowing for pairs of the binder weft yarns, to a number of MS wefts is in a range from 1:1 to 3:1 in one said pattern repeat of the fabric weave pattern.

6. The fabric according to claim 1, wherein a cross-sectional shape of at least some of the warps, the wefts, and/or the binder yarns is selected from one of: generally circular, ovate, elliptical, square or rectangular.

7. The fabric according to claim 1, wherein the PS warps, the PS wefts, the MS warps, the MS wefts and the binder weft yarns are polymeric yarns made from at least one material selected from PET, PA, PBT, PEN, PPS or PEEK.

8. The fabric according to claim 1, wherein a ratio of a number of PS warps to a number of MS warps is in a range from 1:3 to 2:1 in one said pattern repeat of the fabric weave pattern.

9. The fabric according to claim 1, wherein each said MS warp in each said pattern repeat forms at least two of the MS warp knuckles which are spaced apart from one another by 1 to 11 intermediate ones of the MS wefts.

10. The fabric according to claim 1, wherein each said MS warp in each said pattern repeat forms at least two of the MS warp knuckles, and the MS warp knuckles in each said pattern repeat of at least one of the MS warps are spaced apart from one another by 1 intermediate one of the MS wefts and the MS warp knuckles in each said pattern repeat of at least another one of the MS warp yarns are spaced apart from one another by 3 intermediate ones of the MS wefts.

11. The fabric according to claim 1, wherein each said MS warp in each said pattern repeat forms at least two of the MS warp knuckles, and the MS warp knuckles in each said pattern repeat of at least one of the MS warps are spaced apart from one another by 2 intermediate ones of the MS wefts and the MS warp knuckles in each said pattern repeat of at least another one of the MS warp yarns are spaced apart from one another by 5 intermediate ones of the MS wefts.

12. The fabric according to claim 1, wherein each said MS warp in each said pattern repeat forms at least two of the MS warp knuckles, and the MS warp knuckles in each said pattern repeat of at least one of the MS warps are spaced apart from one another by 3 intermediate ones of the MS wefts and the MS warp knuckles in each said pattern repeat of at least another one of the MS warp yarns are spaced apart from one another by 7 intermediate ones of the MS wefts.

13. The fabric according to claim 1, wherein each said MS warp in each said pattern repeat forms at least two of the MS warp knuckles, and the MS warp knuckles in each said pattern repeat of at least one of the MS warps are spaced apart from one another by 3 intermediate ones of the MS wefts and the MS warp knuckles in each said pattern repeat of at least another one of the MS warp yarns are spaced apart from one another by 9 intermediate ones of the MS wefts.

14. The fabric according to claim 1, wherein each said MS warp in each said pattern repeat forms at least two of the MS warp knuckles, and the MS warp knuckles in each said pattern repeat of at least one of the MS warps are spaced apart from one another by 1 intermediate one of the MS wefts and the MS warp knuckles in each said pattern repeat of at least another one of the MS warp yarns are spaced apart from one another by 11 intermediate ones of the MS wefts.

15. The fabric according to claim 1, wherein each said MS warp in each said pattern repeat forms at least two of the MS warp knuckles, and the MS warp knuckles in each said pattern repeat of at least one of the MS warps are spaced apart from one another by 2 intermediate ones of the MS wefts and the MS warp knuckles in each said pattern repeat of at least another one of the MS warp yarns are spaced apart from one another by 6 intermediate ones of the MS wefts.

16. The fabric according to claim 1, wherein each said MS warp in each said pattern repeat forms a single one of the MS warp knuckles which are spaced apart from one another by 5 intermediate ones of the MS wefts.

17. The fabric according to claim 1, wherein pairs of the MS warp knuckles of adjacent MS warps are located adjacent to one another on each of the MS wefts in each said pattern repeat.

18. The fabric according to claim 1, wherein pairs of the MS warp knuckles of MS warps that are spaced apart from one another by a single MS warp are located on each of the MS wefts in each said pattern repeat.

* * * * *